United States Patent [19]

Siemon et al.

[11] Patent Number: 4,834,669

[45] Date of Patent: May 30, 1989

[54] PATCH CONNECTOR

[75] Inventors: John A. Siemon, Watertown, Conn.; Richard Early, San Diego, Calif.

[73] Assignee: The Siemon Company, Watertown, Conn.

[21] Appl. No.: 118,756

[22] Filed: Nov. 5, 1987

Related U.S. Application Data

[63] Continuation-in-part of Ser. No. 879,593, Jun. 27, 1986, Pat. No. 4,759,723.

[51] Int. Cl.[4] ..... H01R 4/24

[52] U.S. Cl. ..... 439/395; 439/409; 439/417

[58] Field of Search ..... 439/391, 395, 409, 410, 439/417, 456, 459, 465, 467, 596, 686, 687

[56] References Cited

U.S. PATENT DOCUMENTS

| | | | |
|---|---|---|---|
| 3,835,444 | 9/1974 | Plana et al. | 339/98 |
| 3,835,445 | 9/1974 | Hardesty | 339/99 R |
| 3,936,933 | 2/1976 | Folk et al. | 29/628 |
| 4,023,879 | 5/1977 | Braund et al. | 439/465 |
| 4,076,365 | 2/1978 | Ross et al. | 339/107 |
| 4,095,862 | 6/1978 | Hatch | 339/97 R |
| 4,125,137 | 11/1978 | Shatto, Jr. | 140/147 |
| 4,145,103 | 3/1979 | Knowles | 339/99 R |
| 4,163,598 | 8/1979 | Bianchi et al. | 439/467 |
| 4,169,648 | 10/1979 | Moist, Jr. | 439/467 |
| 4,191,444 | 3/1980 | Smith et al. | 439/467 |
| 4,252,396 | 2/1981 | Wilson | 339/99 R |
| 4,261,633 | 4/1981 | Abernethy | 339/97 P |
| 4,447,106 | 5/1984 | Houtz et al. | 339/126 R |
| 4,455,058 | 6/1984 | Harner et al. | 439/409 |
| 4,460,229 | 7/1984 | Matthews | 339/99 R |
| 4,585,290 | 4/1986 | Knickerbocker et al. | 439/395 |
| 4,614,028 | 9/1986 | Rich | 29/749 |
| 4,701,138 | 10/1987 | Key | 439/417 |
| 4,759,723 | 7/1988 | Siemon | 439/409 |

FOREIGN PATENT DOCUMENTS

| | | | |
|---|---|---|---|
| 2854903 | 7/1979 | Fed. Rep. of Germany | 439/459 |

OTHER PUBLICATIONS

Thomas & Betts "Field-Installable Station Wire Connector System" Brochure 1985.

*Primary Examiner*—Joseph H. McGlynn
*Attorney, Agent, or Firm*—Fishman, Dionne & Cantor

[57] ABSTRACT

The patch connector comprises separable upper and lower housing portions and a double detent structure for joining the two oppositely disposed housing portions. The housing portions are snapped together to define a substantially rectangular housing having two, four, six or eight openings on a front face thereof for accessing terminals from a terminal block; and at least one other opening on the back face thereof for entry and exit of a cable or individual wires. The interior of the housing is provided with cavities for retaining isolated electrical connector clips, these connector clips communicating with the back face opening for electrical and mechanical connection with insulated wire and communicating with the front face opening for electrical and mechanical connection with terminals from a terminal block. Among other application, the patch connector may be used as a means to electrically connect multiple insulated wires on terminals of a terminal block such as a 66-type terminal block used in the telephone industry.

25 Claims, 9 Drawing Sheets

PATCH CONNECTOR

CROSS-REFERENCE TO RELATED APPLICATION

This application is a continuation-in-part of application Ser. No. 879,593 filed June 27, 1986, now U.S. Pat. No. 4,759,723.

BACKGROUND OF THE INVENTION

This invention relates to an electrical connector intended for use with terminal blocks commonly employed as a means of connection for wire networks. More specifically, this invention relates to an alternate means of making electrical connection between wire and terminal points without the aid of tools or soldering.

While the connection points on the terminal block may be capable of terminating wire directly; via a solder joint or insulation displacement, the patch connector provides a means for making additional connections for temporary or long term use. Once wired, the invention is a multiple wire connector that may be installed and removed from the terminal block without disturbing existing circuits for the purpose of branching off existing lines or connecting together discrete areas of the terminal field.

In the communications industry, and more particularly in the telephone industry, terminal blocks having a plurality of clip type electrical connectors or terminals protruding therefrom are commonly used. One such terminal block is the well known type 66 quick connect block. Having become widely accepted over the last twenty years, the 66-type quick connect blocks have evolved into many shapes and sizes and have been the focal point of a variety of accessories and adapters. Examples of some common adapters offered on the market are quick-connect clips that press onto the 66 terminals and may be terminated in the same manner as the base terminals. These adapters have several limitations. For example, they cannot terminate stranded wire, they require the use of a special tool and cannot be easily relocated without risk or damage to the wire interface or of shorting the tip and ring conductors.

Test adapters that press onto the front of the terminal block are widely used to connectorize the terminals with modular jacks on other industry standard connectors. The limitation of these devices is that they cannot be field wired and they cannot be mounted end to end or side to side without missing terminal locations that may require access. An example of such a test adapter is described in U.S. Pat. No. 4,585,290, assigned to the assignee hereof and incorporated herein by reference. Other examples of prior art test adapters are discussed in U.S. Pat. No. 4,585,290.

SUMMARY OF THE INVENTION

The above discussed and other problems and deficiencies of the prior art are overcome or alleviated by the patch connector of the present invention. In accordance with a first embodiment of the present invention, the unassembled patch connector comprises a preferably one piece, molded housing having a centrally located hinge defining two oppositely disposed housing portions. The housing portions are folded about the hinge and snapped together to define a substantially rectangular housing having two, four, six or eight openings on a front face thereof for accessing terminals from a terminal block; and at least one other opening on the back face thereof for entry and exit of a cable or individual wires. The interior of the housing is provided with cavities for retaining bridge clips, the bridge clips communicating with the front face opening for electrical and mechanical connection with terminals from a block.

The first embodiment of the present invention includes many features and advantages not present in prior art patching devices. For example, the present invention may be used as a termination tool to mount stranded or solid wire on terminals of a terminal block. The hinge aligns bridge clip contacts with wires that are placed into designated slots to terminate during closure without special tools or hardware. A latch mechanism is provided which secures the assembly and provides pressure for the molded-in wire strain relief areas so that no stresses on the cable or wire are transferred to the contact/wire interface. The patch connector will stack side to side and end to end on terminal blocks (i.e., 66 type terminal blocks or other terminal blocks with similar contact spacings). Another feature of the present invention is the incorporation of means for providing polarization to assure proper orientation of the patch by preventing it from seating fully when not properly installed.

In accordance with a second embodiment of the present invention, the patch connector comprises two separable upper and lower body or housing portions and a double detent structure for joining the two housing portions. In addition, this double detent structure permits the two body portions to be initially connected in a preliminary mode wherein the separate conductive wires (corresponding to the number of connector or bridge clips) may be loaded into retaining openings. After this initial attachment, and subsequent wire arrangement, the two body portions are snapped into a final connection mode wherein the individual conductors are simultaneously stripped of insulation thereby leading to electrical and mechanical connection between the electrical bridge clips and the individual conductors.

The second embodiment of the present invention includes many of the important features and advantages of the first embodiment including means for aligning and supporting the bridge clips, a latch mechanism for strain relief and side to side, end to end stackable mounting.

The patch connector of the present invention is designed in multiples of two such that the two conductors which constitute a line may be kept together, yet cannot be shorted. Still another feature of this invention is the ease of field assembly without special tools or operations, (e.g. soldering or crimp tools).

The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
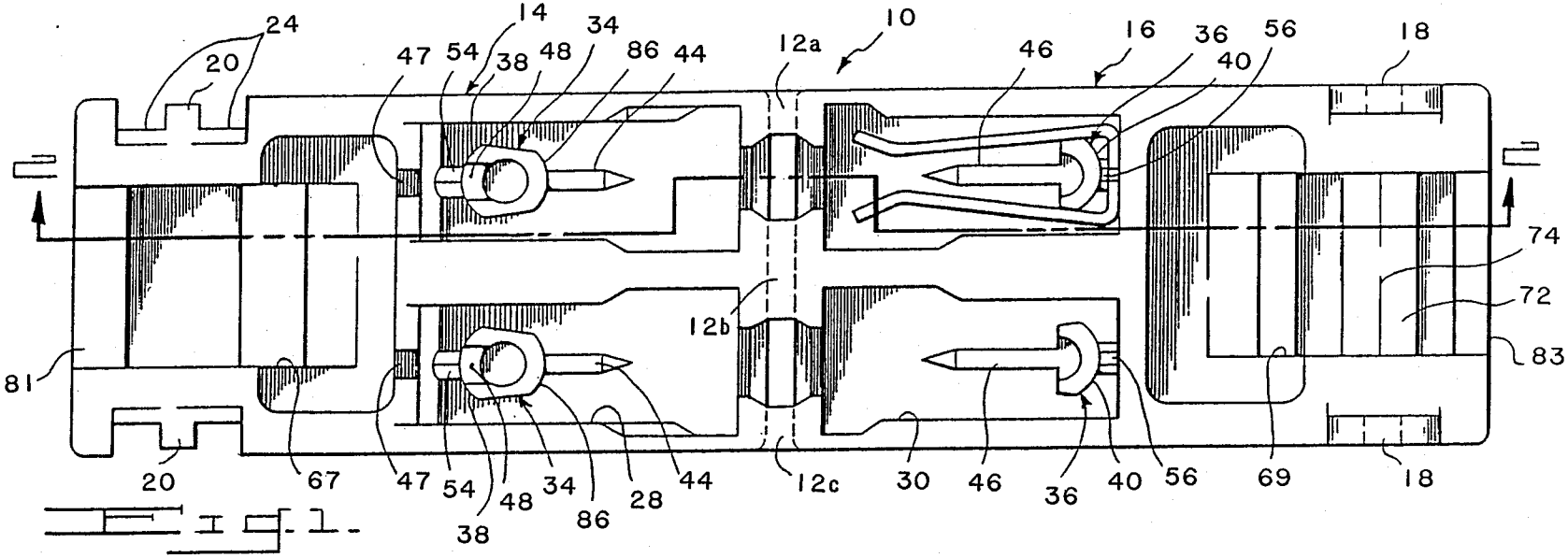
FIG. 1 is a plan view of an unassembled patch connector in accordance with a first embodiment of the present invention.
Figure 2:
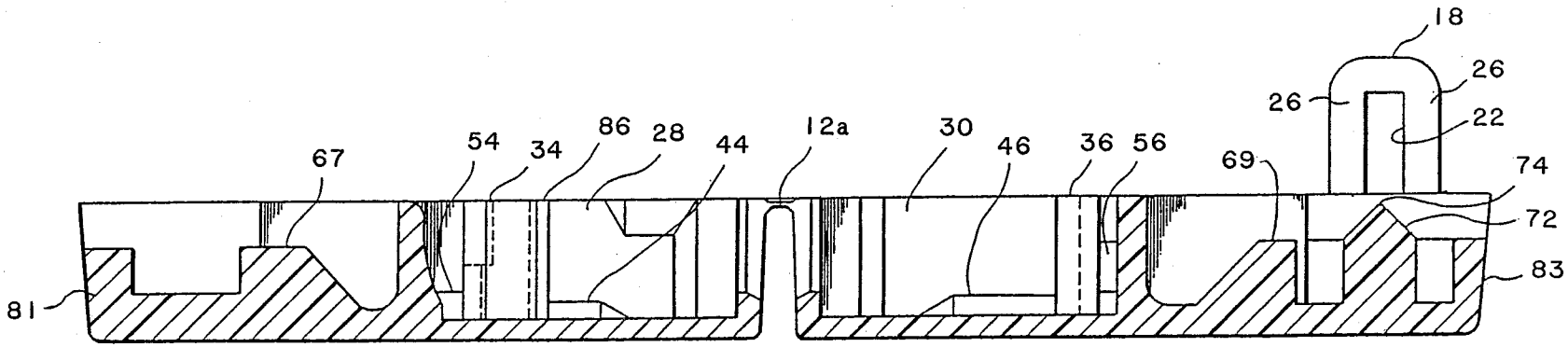
FIG. 2 is a cross-sectional elevation view along the line 2—2 of FIG. 1.
Figure 3:
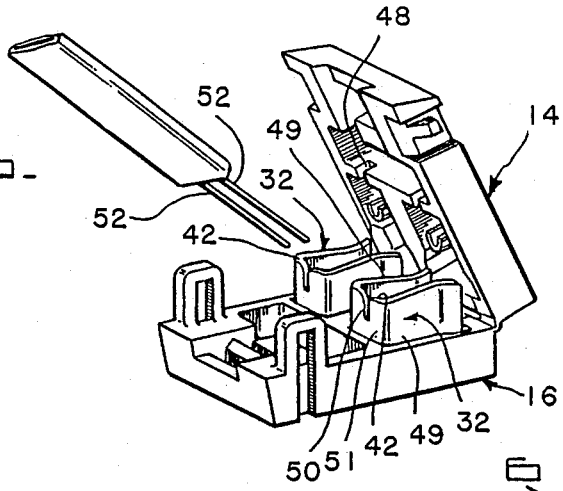
FIG. 3 is a perspective view of the patch connector patch of the present invention during assembly thereof.
Figure 4:
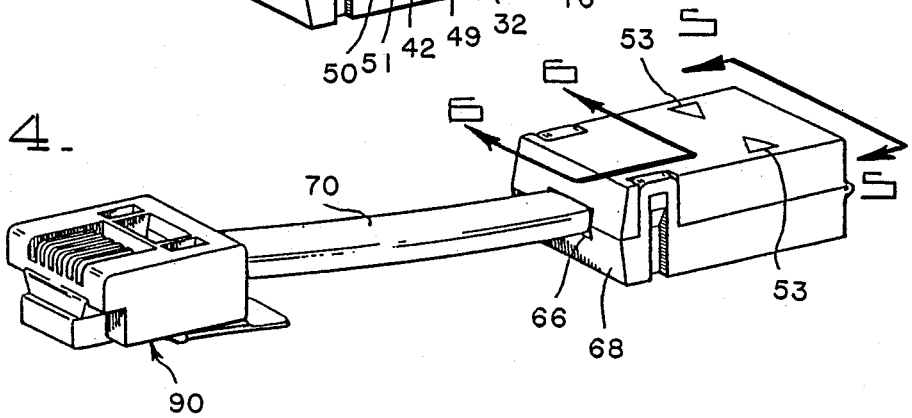
FIG. 4 is a perspective view of the patch connector adapter of the present invention subsequent to assembly thereof and being attached to a modular plug.

Referring simultaneously to FIGS. 1-3, an unassembled housing of a single pair patch in accordance with a first embodiment of the present invention is shown generally at 10. Housing 10 is typically comprised of a suitable insulative material such as a polymeric material (i.e., polyprolylene) and is preferably of a one-piece molded construction. Housing 10 includes centrally located hinge portions 12A, 12B and 12C. Hinges 12A-12C define two oppositely disposed first and second housing portions 14 and 16. As will be discussed hereinafter, housing 10 is foldable or bendable about hinges 12A-C such that housing portions 14 and 16 will mate and thereby define a substantially rectangular assembled housing (see FIGS. 3 and 4). Mated housing portions 14 and 16 are preferably held together by a snap action connecting means comprised of a pair of resilient extended slotted latches 18 and extensions 20. Thus, during closure, resilient latches 18 will contact extensions 20 whereupon latches 18 will be urged outwardly from housing 10 and wherein extensions 20 will be received by and retained in slots 22 of latches 18. It will be appreciated that extension 20 is provided with a pair of oppositely disposed channels 24 which are sized to receive the two parallel legs 26 of slotted latch 18.

Each of housing portions 14 and 16 are provided with cavities 28 and 30 for housing and retaining electrical connector clips such as the bridge clips shown at 32 in FIGURE 3. Bridge clips 32 or other suitable electrical connectors are rigidly contained within cavities 28 and 30 by the surrounding side walls of the cavities as well as by a central support structure identified at 34 and 36 respectively. As shown in FIG. 1, each central support structure has an arcuate section 38 and 40 which preferably matches and corresponds to the interior arcuate section 42 of each bridge clip 32. Central support structures 34 and 36 also include longitudinal alignment ridges 44 and 46 which help to centralize and align a bridge clip 32 during insertion into cavity 28 or 30. Alignment ridges 44 and 46 also help to limit lateral movement of the patch unit 10 when mated with the terminal block.

First housing portion 14 is preferably provided with a pair of aligned slots 47 and 48 for receiving and holding a wire prior to assembly of housing 10. During assembly, bridge clips 32 are preferably loaded into cavities 30 (rather than cavities 28). Also in a preferred embodiment, bridge clips 32 are of the "quick connect" type which permits relatively quick connections between wire means and the clips 32. Such "quick connect" type bridge clips have a well known construction including a pair of oppositely disposed arms 49 connected at a generally arcuate base 51 with arms 49 extending from the base 51. Arms 49 coverage to a point whereupon the arms diverge and terminate at an entrance section. The entrance section is adapted to receive a terminal from the terminal block and effect electrical and mechanical connection therewith. Bridge clips 32 further include stripping slots 50 (insulation displacement connector slots or IDC slots) centrally disposed therein (see FIG. 3). Thus, during assembly, bridge clips 32 are loaded into cavities 30 while individual wires or leads 52 are loaded into slots 47 and 48. Typically, the bridge clips are loaded into the patch connector during manufacturing so that the installer must only load leads 52 into slots 47 and 48. Next, second housing portion 16 is swung about hinges 12A-C whereby wire leads 52 will be engaged by stripping slots 50. As housing portion 16 engages with housing portion 14 and snaplocks thereto via the snaplock latch mechanism discussed above, wire leads 52 will be electrically and mechanically engaged with stripping slots 50 and thereby effect an electrical connection between wire leads 52 and bridge clips 32. It will be appreciated that corresponding cavities 28 and 30 will mate to define internal chambers for holding and retaining bridge clips 32.

Arrows 53 or other indicia are provided on the housing exterior to designate the area in which the installer should apply force to effect termination. While not necessary, a plier or other hand tool may be used to effect closure.

An important feature of the present invention is the presence of ribs 54 and 56 which are aligned with alignment ridges 44 and 46, respectively. Ribs 54 and 56 will engage the stripping slot on the bridge clip subsequent to loading and thereby center and hold the bridge clip in place during the assembly of housing 10. Since bridge clips 32 are preferably loaded into cavity 30, ribs 56 should have a relatively larger height as compared to ribs 54. It will be appreciated that the height of ribs 54 should be below the bottom of wire holding slots 48.

Figure 5:
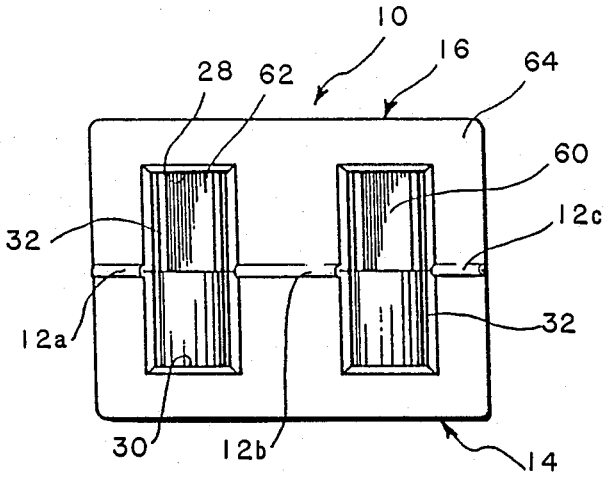
FIG. 5 is a front elevation view along the line 5—5 of FIG. 4.

Subsequent to connection between mating housing portions 14 and 16, a plurality of apertures 60 and 62 will be formed on the front face 64 of rectangular housing 10 (usually 2, 4, 6 or 8 openings) and a single rear opening 66 will be formed on the back face 68 of housing 10. Rear opening 66 will lead into an interior recess formed by recessed portions 67 and 69 of housing portions 14 and 16, respectively. It will be appreciated that slots 48 permit communication between opening 66 and the interior recess (formed by recessed portions 67, 69) on one side thereof; and cavities 28 and 30 on the other side thereof. As shown in FIG. 5, apertures 60 and 62 formed in front face 64 are substantially rectangular and are configured to accept and receive terminals (see FIG. 9) from a terminal block which will mate with the bridge clips 32 disposed interiorly of housing 10. Rear aperture 66 is configured to permit exit and entry of a cable 70 which encases the individual wires 52 as shown in FIG. 3.

Figure 6:
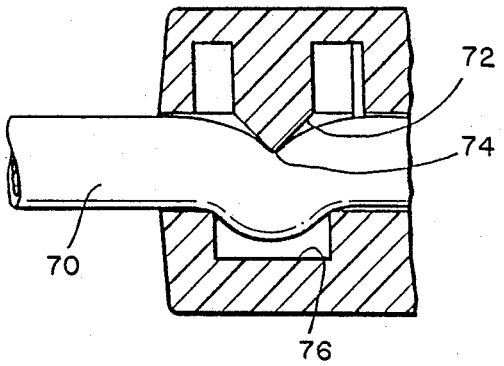
FIG. 6 is a cross-sectional elevation view along the line 6—6 of FIG. 4.

In a preferred embodiment of the present invention, housing 10 is provided with a strain relief mechanism to relieve the strain on cable 70 and preclude undesired disconnection between wires 52 and bridge clips 32. Referring to FIGS. 1 and 2, the cable strain relief comprises a ramped protrusion 72 which defines an edge 74, ramp 72 being located, for example, in second housing portion 16 in the area of latch mechanism 18; and a recess 76 which is also located in the snaplock area of the other housing portion, in this case, housing portion 14. During closure between the first and second housing portions 14 and 16, cable 70 will be positioned between edge 74 of ramp 72 in recess 76. As shown in FIG. 6, subsequent to closure between housing portions 14 and 16, cable 70 will have strain relief in that portion of cable 70 wherein the ramp extension 72 and particularly edge 74 contacts cable 70. As a result of the contact, cable 70 will bend to a certain extent and be received by cavity or recess 76.

The foregoing description relating to FIGS. 1–3 and 6 is concerned with a single pair patch for terminating jacketed station wire. In another variation of the first embodiment of the present invention shown at FIGS. 7 and 8, a single pair patch is presented which is specifically configured for use with nonjacketed solid or stranded wire (typically 22–24 AWG). This second variation includes a strain relief mechanism for twisted part cross-connect wire. For the most part, the alternative variation of a single pair patch identified at 10' in FIGS. 7 and 8 is identical to the FIG. 1 embodiment and therefore identical structural elements are identified in the same manner with the addition of a prime.

Figure 7:
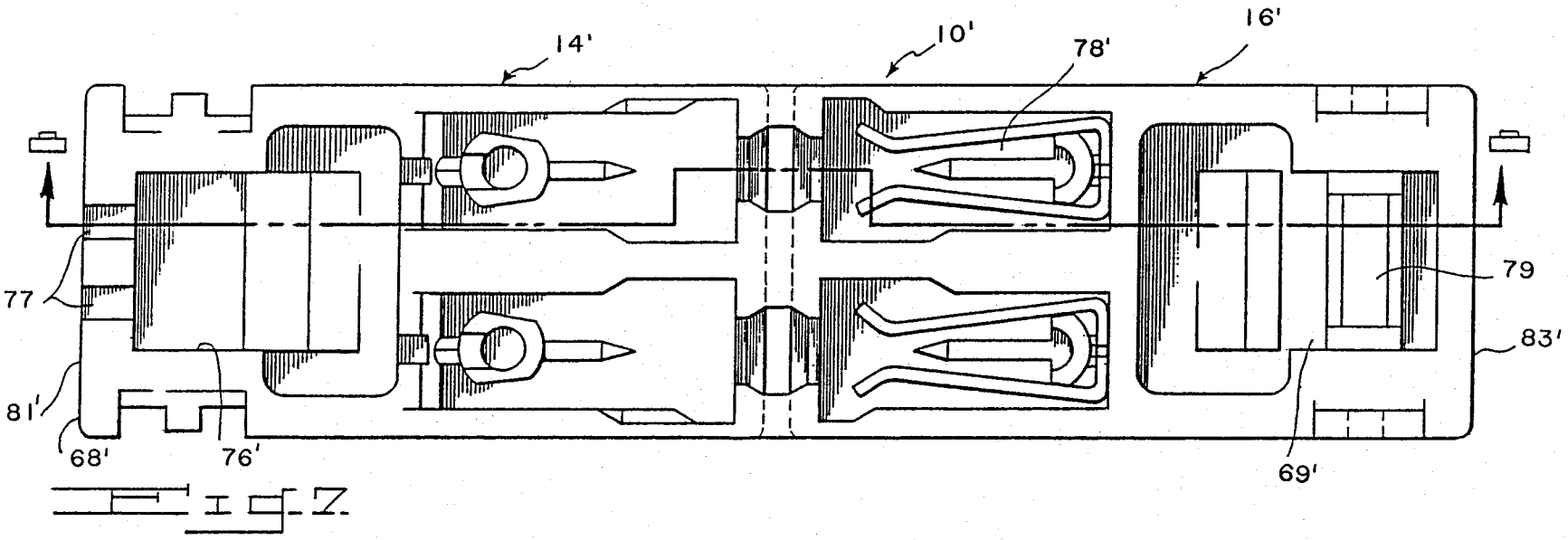
FIG. 7 is a plan view similar to FIG. 1, of a variation of the single pair patch of FIG. 1 prior to assembly.
Figure 8:
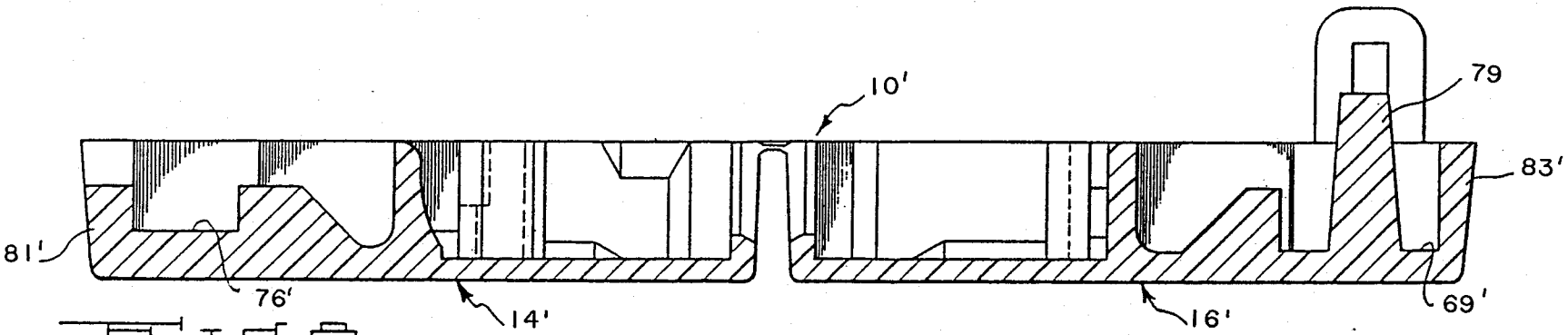
FIG. 8 is a cross-sectional elevation view along the line 8—8 of FIG. 7.
Figure 10:
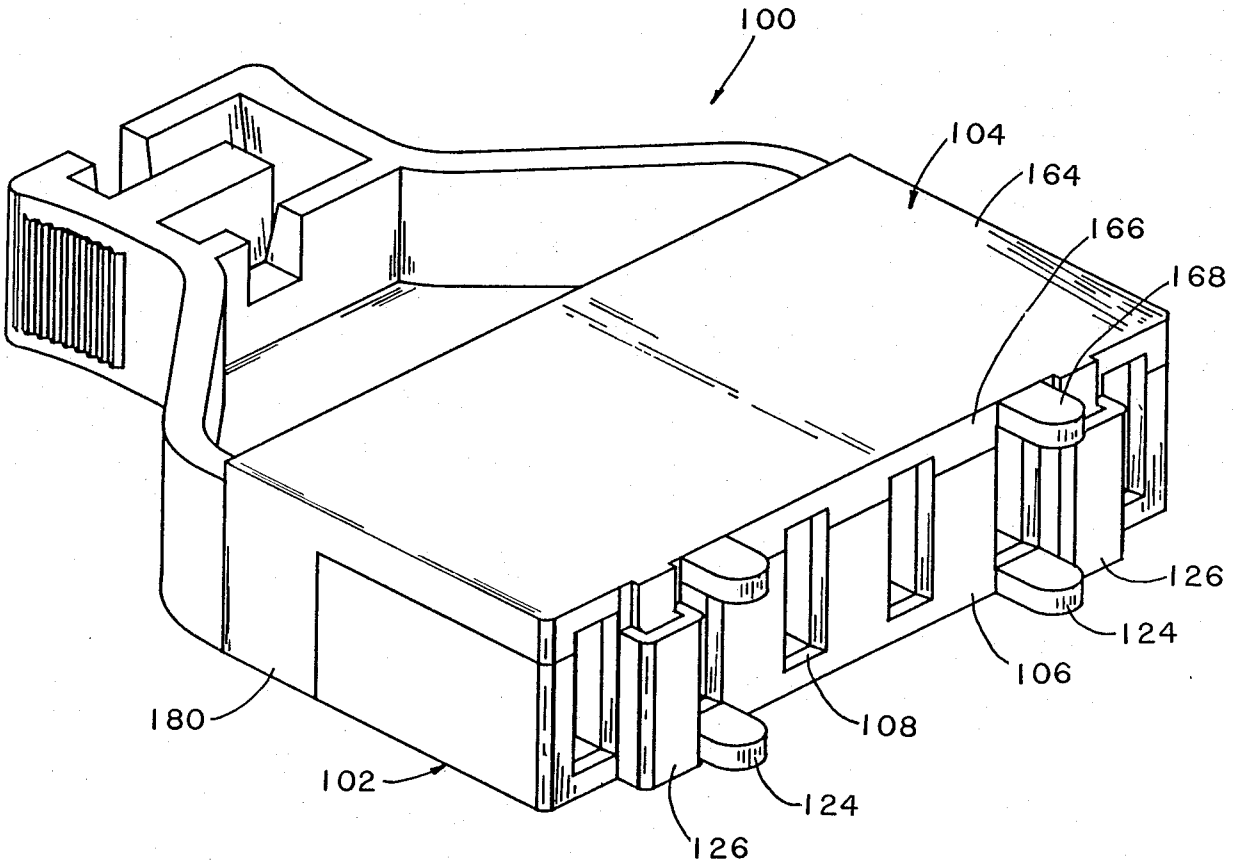
FIG. 10 is a perspective view of a an unwired patch connector with cover portion in final detent position in accordance with a second embodiment of the present invention.

In FIGS. 7 and 8, a pair of rear openings in the form of grooves 77 are provided for entry of individual wire leads (rather than a single jacketed cable as in FIGS. 1 and 2) from rear face 68' to recess 76'. Strain relief means are also provided to the FIGS. 7 and 8 embodiment which are especially configured for use with individual solid or stranded wire leads. The strain relief means comprises a protrusion 79 extending from a recess 69' of a housing portion 14' or 16' (recess 69' of housing portion 16' in the example not shown). Protrusion 79 has a flat top and extends upwardly and outwardly of housing portion 16'. Protrusion 79 is adapted to be received by recess 76' of housing portion 14'. As with the strain relief means of FIG. 6, blunt-edged protrusion 79 will contact the individual wire leads causing the individual wires to bend to a certain extent and be received by recess 76'. The only other significant differences between the single pair patch of FIGS. 7 and 8, and that of FIGS. 1 and 2 is that the end walls 81' and 83' (which together form rear face 68') have a larger height relative to end walls 81' and 83' of housing 10. This is due to the absence of a single large rear opening 66 (and replacement with a pair of grooves 77) in the FIG. 7 embodiment of the present invention.

Figure 9:
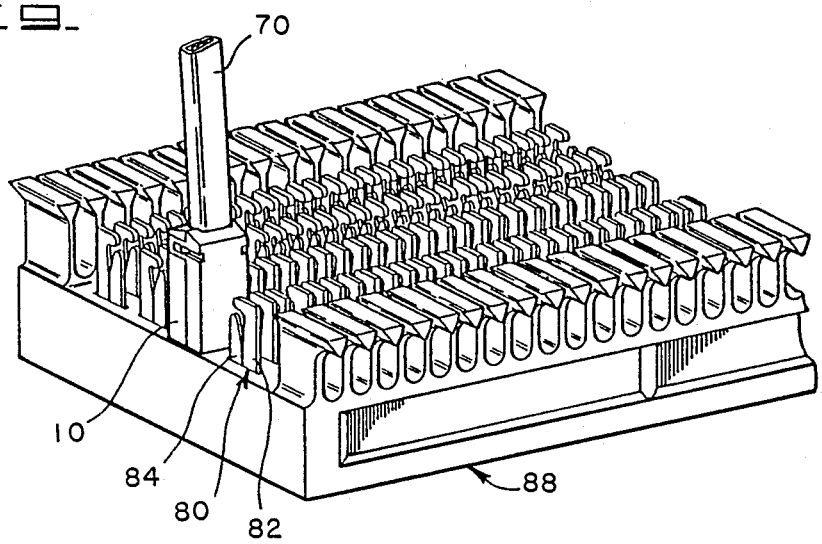
FIG. 9 is a perspective view of the first embodiment of the present invention subsequent to connection with terminals from a terminal block.

Another important feature of the present invention is the incorporation of means for polarizing or pseudo-polarizing the single pair patch on the terminals. This polarization means prevents the patching device from fully seating on the terminals extending from the terminal block (or conversely, it permits the patching device to fully seat on the terminals when correctly oriented). Referring to FIG. 9, a 66-type quick connect terminal 80 comprises two members 82 and 84 of which member 82 has a larger height than member 84. Thus, when a single pair patch 10 is inserted onto terminals 80 via openings 60, 62 member 82 will extend outwardly of member 84 and therefore be closer to rear face 68. Referring again to FIGS. 1 and 7, second housing portion 16 includes a pair of central supports 36. Comparing supports 36 of housing portion 16 to supports 34 of housing portion 14, it is evident that each support 34 includes a lower arcuate portion 86 which is not present in supports 36. As a consequence, subsequent to assembly, lower arcuate portions 86 on supports 34 will act as a block to preclude terminal members 82 from passing therethrough. Conversely, supports 36 (without lower arcuate portions 86) will permit terminal members 82 to pass therethrough. The result is a pseudo-polarized patching device which permits firm seating on a pair of 66-type terminal in one direction or orientation only. Thus, in FIG. 9, a single pair patch 10 in accordance with the present invention is shown subsequent to being terminated to two pair jacketed cable 70 and being connected onto a pair of 66-type terminals 80 extending from a well known 66M or B terminal block 88.

As discussed individual wire leads or jacketed cable may be electrically and mechanically connected to patching 10. These leads or cable may then terminate onto another block, test equipment, or any other suitable location including a modular jack or plug such as the well known modular plug 90 shown in FIG. 4.

Referring to FIGS. 10–21, a second embodiment of a patch connector in accordance with the present invention will now be discussed. This second embodiment of the present invention is shown generally at 100 in FIG. 10 subsequent to assembly thereof. Patch connector 100 is comprised of a preferably insulative plastic housing comprised of two separable parts, a lower first housing section 102 and an upper second housing section 104. Lower housing section 102 is shown in detail in FIGS. 11–15 and upper housing section or cover plate 104 is shown in detail in FIGS. 16–18.

Turning now to a discussion of the lower housing section, lower housing section 102 is comprised of a non-conductive body which includes a front face 106 (FIG. 13) having a plurality of openings 108 therethrough. Openings 108 preferably have a frustoconical cross section to facilitate entry of a terminal from a terminal block. It will be appreciated that while the FIG. 10 embodiment includes six openings 108 (a three pair patch connector), the present invention contemplates any number of openings 108 therethrough. However, these openings are generally numbered in pairs (2, 4, 6 or 8) when used in the communications and more particularly the telephonic field. As in the first embodiment, each opening 108 in the second embodiment communicates with and is received by cavities 110 for housing and retaining electrical connector clips such as bridge clips 112 therein (see FIGS. 19–21). A channel 114 interconnects openings 108 with cavities 110. Bridge clips 112 or other suitable electrical connectors are rigidly contained within cavities 110 by the surrounding sidewalls of the cavities as well as by a central support structure identified at 116. Central support structure 116 has a section 118 which preferably matches and corresponds to the interior arcuate section of each bridge clip 112. Central support structure 116 also includes longitudinal alignment ridges 120 which help to centralize and align a bridge clip 112 during insertion into cavity 110. Alignment ridges 120 also help to limit lateral movement of the patch unit 100 when mated with the terminal blocks. Support structure 116 further includes ribs 122 which are aligned with alignment ridges 120. Ribs 122 will engage the bottom stripping slot on the bridge clip subsequent to loading and thereby center and hold the bridge clip in place during assembly of the two housing portions 102 and 104. It will be appreciated that bridge clips 112 used in the second embodiment of the present invention are the same as those used in the first embodiment which have been described in detail hereinabove.

Front face 106 of the lower body section 102 further includes a pair of laterally spaced rounded extension members 124. Extension members 124 may be integrally molded to body section 102 and are intended to be used for providing a set-off or spacing back function to patch connector 100 subsequent to installation onto a telephone or other terminal block as shown in FIG. 9. This spacing allows for the presence of wire on the face of the terminal block.

Also located on front face 106 adjacent to each of the extension members 124 are a pair of spaced U-shaped walls 126 which form a pair of slots or channels 128. As will be discussed hereinafter, channels 128 are adapted for receiving latch members which extend from the upper body portion or cover plate 104.

At about the mid section of lower body section 102 are two oppositely disposed lips 128 and 130. Lips 128 and 130 are parallel to the top and bottom surfaces 132, 134 respectively of body 102 and are transverse to front face 106. It will be appreciated that each lip 128, 130 is spaced from the upper and lower surfaces 132, 134 of body portion 102. Lips 128 and 130 are positioned in a cut out section 136 and 138, respectively. As will be discussed hereinafter, particularly with regard to FIGS. 19–21, lips 128 and 130 form a part of an important double or dual detent structure used during assembly of the second embodiment of the present invention.

Figures 11, 12, 13:
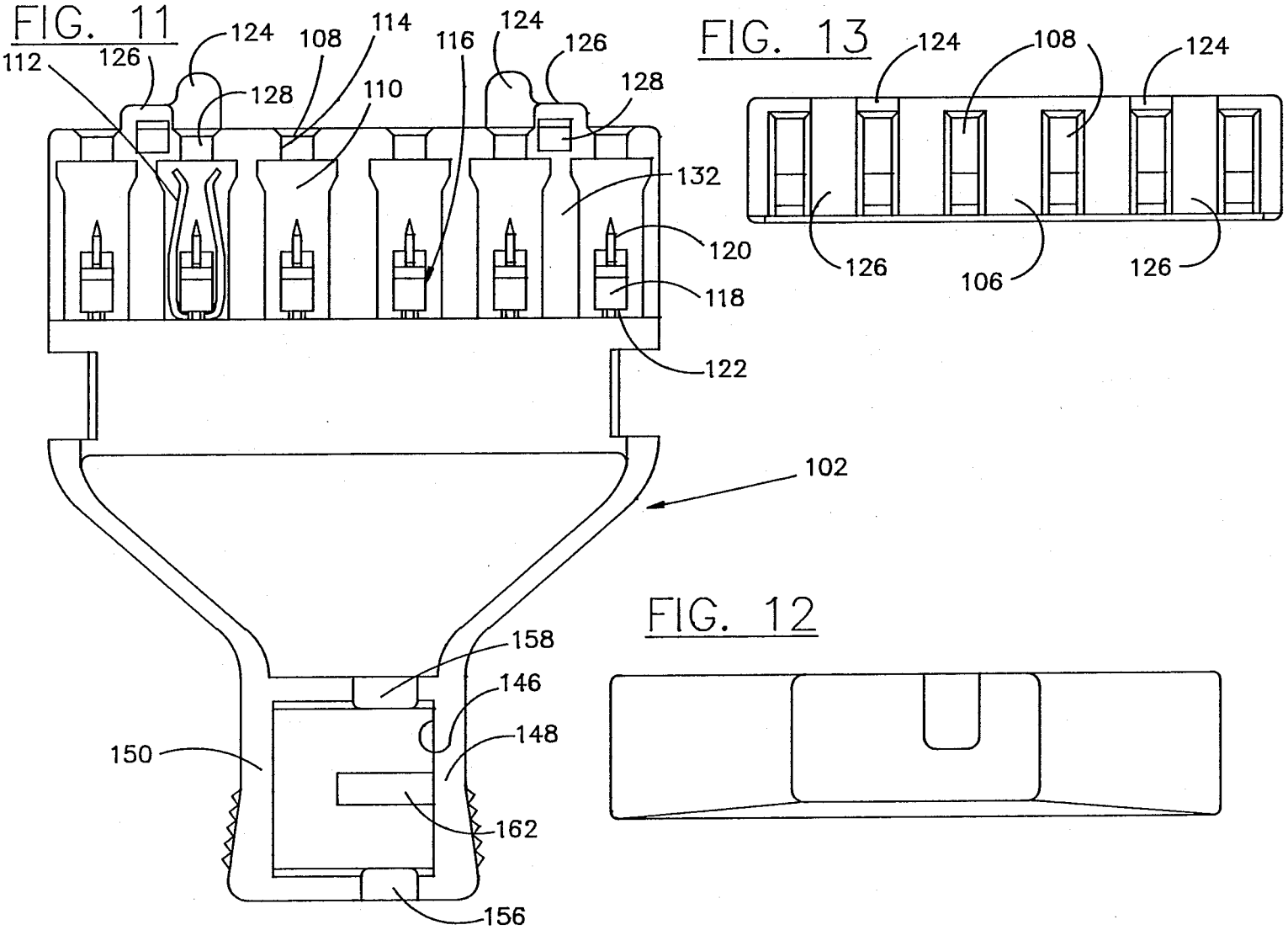
FIG. 11 is a plan view of the lower body portion of the patch connector of FIG. 10.
FIG. 12 is a end view of the lower portion of FIG. 11.
FIG. 13 is a front view of the lower body portion of FIG. 11.
Figure 15:
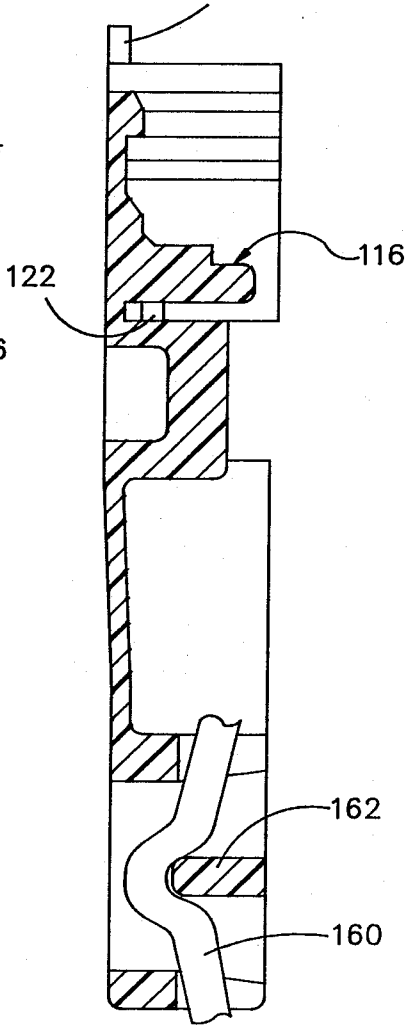
FIG. 15 is a cross sectional elevation view along the line 15—15 of FIG. 14.
Figure 14:
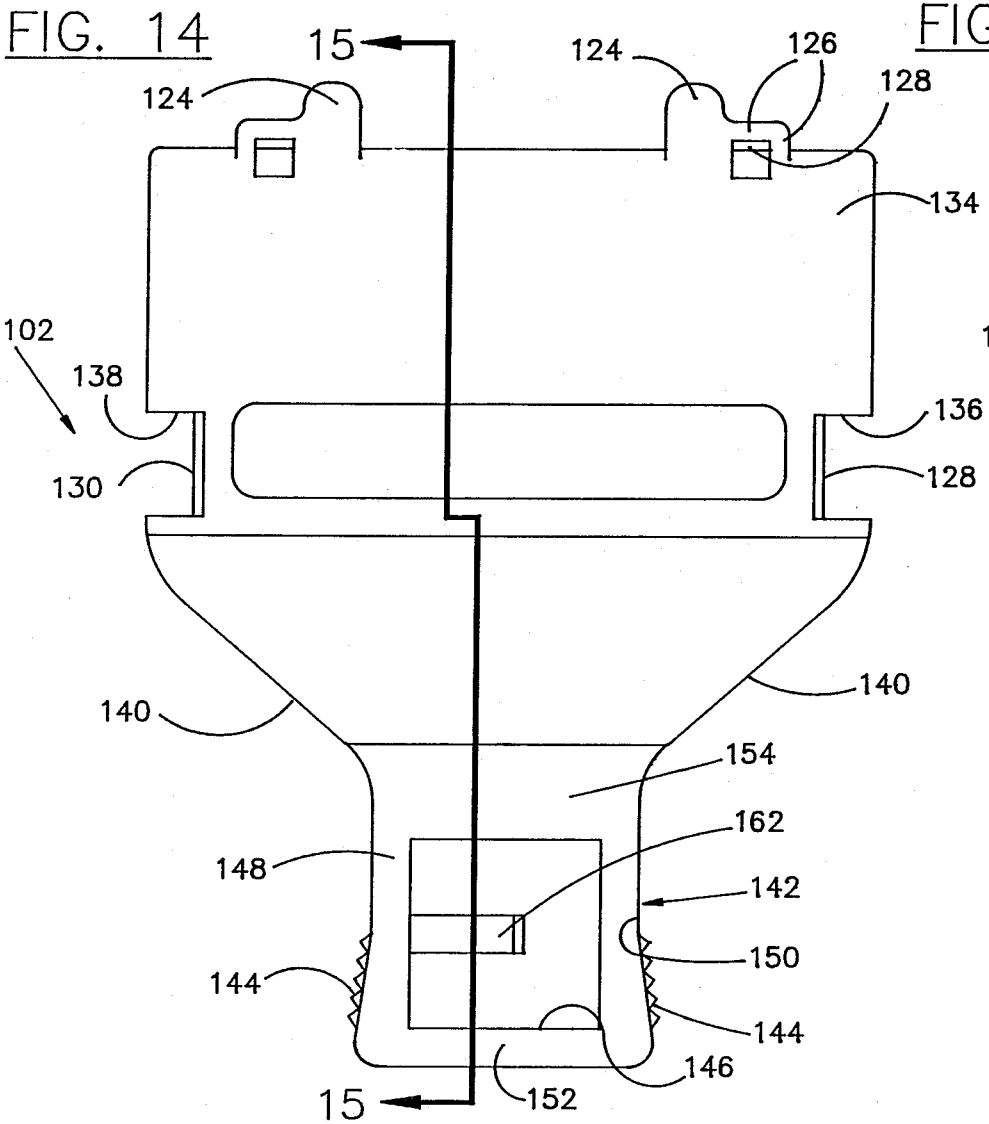
FIG. 14 is a bottom view of the lower body portion of FIG. 11.

As is clear from FIGS. 11 and 14, that portion of patch connector 100 which is adapted to be received by terminals from a terminal block has a substantially rectangular configuration. However, from about the lips 128, 130 of the mid section of body portion 102, the configuration of patch connector 100 changes. In this area of body portion 102, the general shape of the body converges at converging sidewalls 140 to a rear section which preferably includes a strain relief mechanism. As is shown in FIGS. 11, 12, 14 and 15, the strain relief mechanism is located in a handle 142 which is used by the installer to install patch connector 100 onto a terminal block or the like. Handle 142 includes oppositely disposed serrated edges 144 which aid the installer in achieving a firm grip with patch connector 100. Within handle 142 is a rectangularly shaped opening 146 defined by two parallel sidewalls 148 (each sidewall 148 including serrated edges 144 thereon) and a pair of transverse walls 152 and 154. Transverse walls 152 and 154 each include aligned grooves 156 and 158 for the purpose of receiving a cable (shown at 160 in FIG. 15) therein. A lateral extension member 162 extends into opening 146 from sidewall 148. Lateral extension 162 is spaced from opposite sidewall 150. In this way, a cable 160 is placed onto recesses 156 and 158 and looped under lateral extension 162 as shown in FIG. 15. As a result, strain is relieved from cable 160 thereby avoiding serious problems stemming from disconnection of the conductors in cable 160 from the bridge clips as discussed hereinafter.

Figure 16:
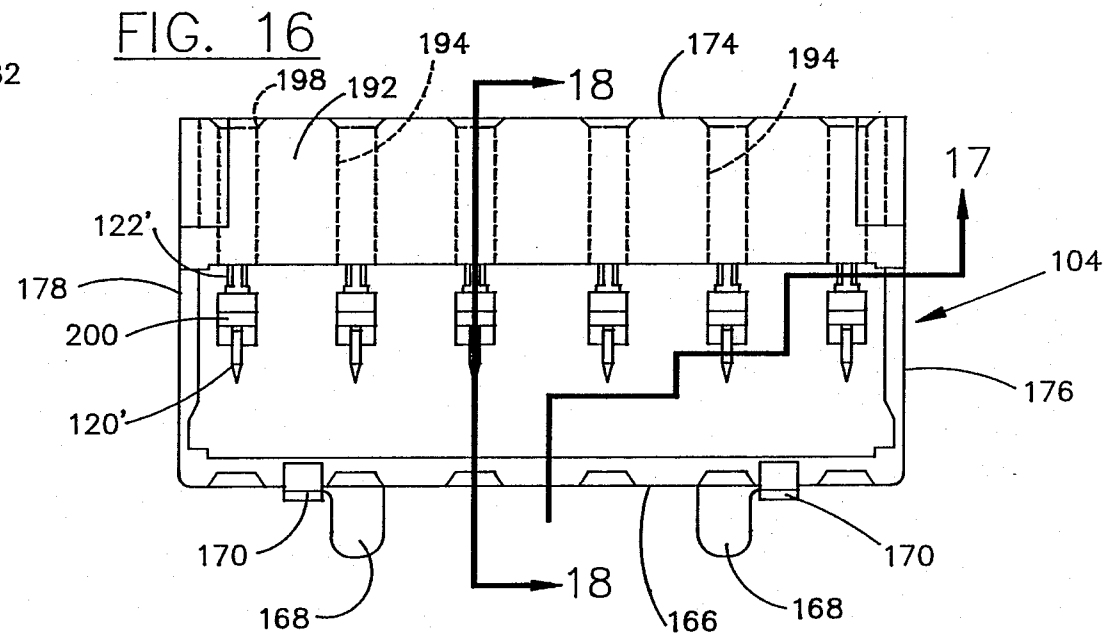
FIG. 16 is a bottom view of the upper portion of the patch connector of FIG. 10.
Figure 17:
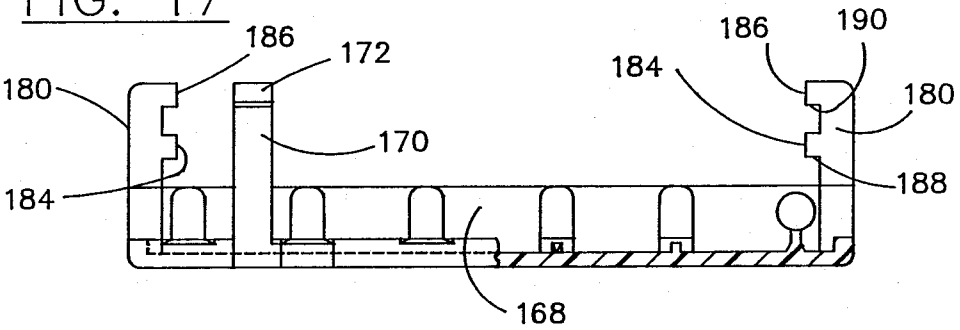
FIG. 17 is a front view of the upper body portion of FIG. 16 with cut away detail along line 17 of FIG. 16.
Figure 18:
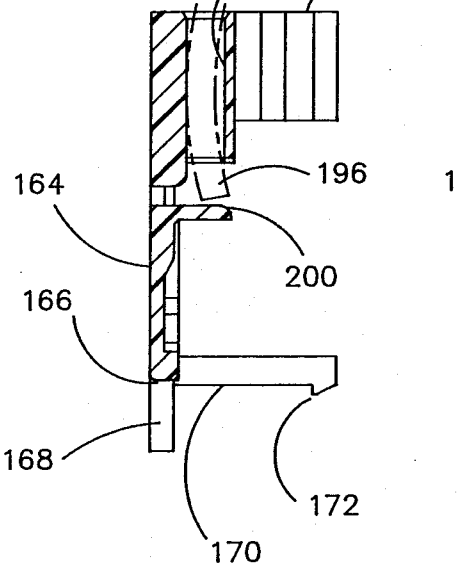
FIG. 18 is a cross sectional elevation view along the line 18—18 of FIG. 16.

Referring now to FIGS. 16–18, the upper body portion or cover plate 104 will now be discussed. Cover plate 104 includes an upper planar section 164. Flattened portion 164 terminates at a front face 166 which, subsequent to assembly, corresponds to and is coterminous with front face 106 on lower body portion 102. Front face 166 includes a pair of stand-off extensions 168 which are used for the same purpose as stand-off extensions 124 on body portion 102. Stand-off sections 168 are coplanar with top surface 164. Extending from front surface 166 and transverse to top surface 164 are a pair of resilient latches 170 which terminate at a hook portion 172. It will be appreciated that during assembly of patch connector 100, resilient latches 170 are received within channels 128 of body portion 102 whereupon latch member 172 will outwardly deflect and then snap back and be retained by wall 126.

Cover 104 also includes a rear face 174 which communicates between a pair of side faces 176 and 178. At the junction between side faces 176, 178 and rear face 174 are two depending and resilient dual detent arm structures shown generally at 180. Depending arms 180 each include a pair of lateral spaced fingers 184 and 186. The junctures between lateral fingers 184 and arms 180 define therebetween a first shelf 188 and the junctures between fingers 186 and arms 180 define therebetween a second shelf 190. Depending arms 180 and the respective shelves 188 and 190 are adapted to be received by lips 12 and 130 on lower body 102 as will be discussed with reference to FIGS. 19–21. Between depending arms 180 is a block 192 which includes a plurality of cylindrical openings 194 therethrough. As shown in FIG. 18, openings 194 are sized to receive a conductor 196. The rear end of each cylindrical opening 194 includes a frustoconical section 198 which aids in receiving wire 196 and guiding it towards cylindrical opening 194. Spaced a preselected distance from the outlet of each cylindrical opening 194 is a retaining wall 200 which acts as a stop to a conductor 196 which has been brought through each cylindrical opening 194.

As in lower body portion 102, cover portion 104 also includes bridge clip alignment ridges 120' and ribs 122' (aligned with ridges 120') for engaging the stripping slot of a bridge clip.

Figures 19A, 19B, 20A, 20B, 21A, 21B:
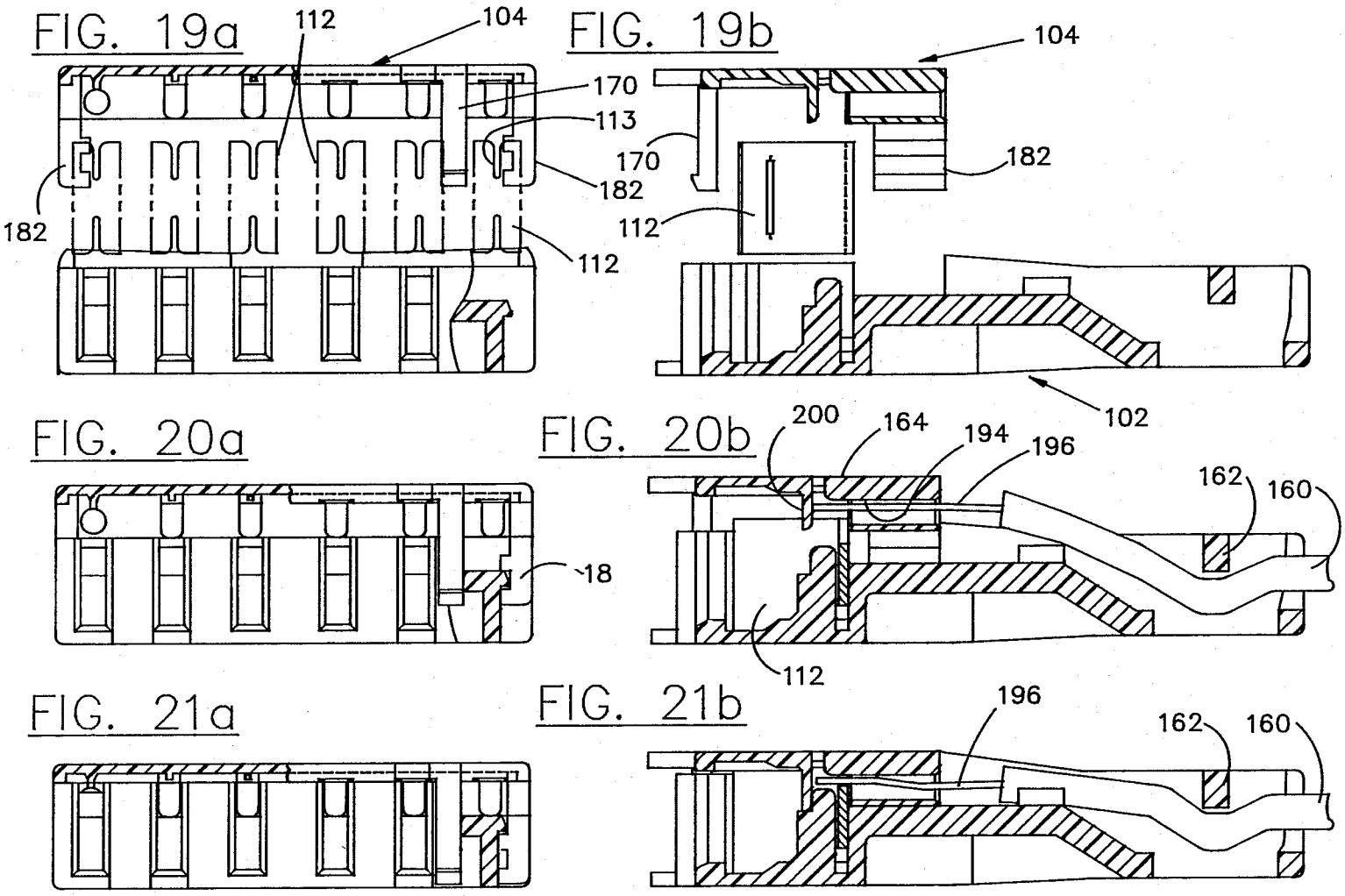
FIGS. 19A and 19B are exploded front and side elevation views, respectively, of the patch connector of FIG. 10 prior to assembly.
FIGS. 20A and 20B are front and side elevation views, respectively, of the patch connector of FIG. 10 shown connected in a first detent position.
FIGS. 21A and 21B are front and side elevation views, respectively, of the patch connector of FIG. 10 shown connected in a second fully closed position with wires in place.

Turning now to FIGS. 19–21, assembly views of the patch connector of the second embodiment of the present invention are shown. In FIGS. 19A and 19B, exploded views are shown prior to assembly wherein a plurality (in this case six) of connector elements or bridge clips 112 are loaded into each cavity 110. Next, top body portion or cover 104 is suspended over lower body section 102 such that resilient latches 170 align with the channels 128 and depending arms 180 are aligned with the respective lips 128 and 130 on main body portion 102.

As shown in FIGS. 20A and 20B, resilient latches 170 are received through slots 128 of main body portion 102 and depending arms 182 are engaged by lips 128 and 130 such that the shelves at 190 snap lock onto lips 128 and 130 to define a first detent position. At this first preliminary detent position, jacketed or unjacketed wire 160 may be fed into body portion 102 through the strain relief means as shown in FIG. 20B. Next, the individual conductors from cable 160 are separated and loaded into each of the cylindrical openings 194 as shown in FIG. 20B. Each conductor 196 will protrude outwardly from cylindrical opening 194 a preselected distance which is governed by the stop wall 200. It will be appreciated that openings 194 will align each conductor 196 so that conductors 196 are suspended directly over an insulation displacement slot 113 on bridge clip 112.

Next, as shown in FIGS. 21A and 21B, pressure is exerted on top surface 164 of cover 104 whereby resilient arms 182 will be deflected outwardly and then snap down into a second detent position (see FIG. 21A). In the second detent position, the shelves identified at 188 in arms 180 will be in contact with lips 128 and 130 to define a second, final detent position. In addition, resilient latches 170 will also be deflected and then snap locked such that locking means 172 from cover 104 is retained by body portion 102. It will be appreciated that between the first and second detent positions, each of the conductors 196 of cable 160 will be forced through slots 113 of bridge clips 112 whereby the insulation will be displaced from the conductors and a strong electrical and mechanical connection between each conductor 196 and bridge clip 112 will be effected. At this point, patch connector 100 of the present invention is fully assembled and is ready for use in conjunction with a terminal block or the like.

As in the first embodiment of the present invention, patch connector 100 of the second embodiment is particularly well adapted for use in conjunction with a terminal block such as used in the telephone industry and shown in FIG. 9. Thus, openings 108 (which are now loaded with bridge clips 112 and electrically connected to a cable 160) are aligned with the requisite number of terminals 80 (in this case six) and the patch connector is then inserted (using finger grips 144) onto the terminal blocks whereby mechanical and electrical connection is made between the resilient bridge clips 112 and the terminals 80. Of course, as in the first embodiment, patch connector 100 may comprise any number of bridge clips and associated bridge clip holding cavities and will usually comprise an even number of said cavities. Presently, in the communications industry, 2, 4, 6 or 8 pairs are normally used. However, other combinations of bridge clips and cavities are contemplated by and encompassed by the present invention.

The patching device of the present invention has many important features and advantages including the following:

(1) Adds flexibility to existing 66-type block installations;

(2) Low cost alternative to other patch systems;

(3) Allows multiple terminations on a single 66-type terminal clip;

(4) Permits quick assembly and installations;

(5) Permits side by side and end stacking on terminal blocks (i.e, 66M blocks);

(6) Terminates 22–24 gauge solid and stranded wire whereas the standard 66 type terminal clips will only terminate solid wire;

(7) Permits easy and therefor inexpensive circuit rearrangements;

(8) Provides cost effective modular patching for data application; and (9) In addition, the relatively simple construction leads to low manufacturing costs.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A patch connector for accessing at least a pair of terminals extending outwardly from a terminal block comprising:

housing means including a first housing portion and a second housing portion, said first housing portion being attachable to said second housing portion, said housing means having a front face and a rear face;

means for attaching said first and second housing portions in at least two positions including a preliminary conductor loading position and a final closed position, wherein said first housing portion is positioned in a first plane when in said preliminary conductor loading position and wherein said first housing portion travels in a linear direction to a position in a second plane when moved from said preliminary conductor loading position to said final closed position, said first and second planes being mutually parallel;

at least a pair of spaced conductor retaining means in said first housing portion, each of said retaining means adapted to align a single conductor in a pre-selected position when said first and second housing portions are attached in said preliminary position;

at least a pair of cavities in said second housing portion communicating with said conductor retaining means, said cavities defining at least a pair of electrical connector clip chambers;

a discrete electrical connector clip in each of said electrical connector clip chambers; and said front face of said housing means having at least a pair of apertures, one each of said apertures communicating with one each of said chambers, each of said apertures being large enough to receive a terminal extending from a terminal block and permit electrical contact between the terminal and said connector clip.

2. The patch connector of claim 1 including:

support means for supporting and aligning said connector clips in said chambers.

3. The patch connector of claim 1 wherein:

said means for attaching said first and second housing portions in at least two positions comprise first snap action connecting means.

4. The patch connector of claim 3 wherein said first snap action connecting means comprise:

a pair of oppositely disposed resilient arms depending from said first housing portion, each of said arms including at least two detent means; and a pair of oppositely disposed lips extending outwardly from said second housing portion, said lips cooperating with said two detent means to define said preliminary and final positions.

5. The patch connector of claim 1 wherein:

said spaced conductor retaining means each comprises a cylindrical opening through a wall of said first housing portion.

6. The patch connector of claim 1 wherein each of said conductor retaining means includes a conductor entrance section and a conductor exit section and wherein:

said conductor entrance section has a frustoconical configuration.

7. The patch connector of claim 1 wherein each of said conductor retaining means includes a conductor entrance section and a conductor exit section and including:

edge means depending from said first housing portion for preventing conductor travel, said edge means being spaced from said exit section.

8. The patch connector of claim 3 including:

second snap action connecting means for retaining said first and second housing portions in said final position.

9. The patch connector of claim 8 wherein said second snap action connecting means includes:

a pair of resilient latch means attached to said first housing portion and extending outwardly thereof; and a pair of channels on said second housing portion for receiving said latch means wherein when said resilient latch means emerges from said channels, said latch means will be urged outwardly from said housing means and wherein said latch means will be received by and retained in said channels.

10. The patch connector of claim 9 wherein said first and second housing portions each have a front face and wherein:

said latch means are located on said front face of said first housing portion; and wherein said channels are defined by walls located on said front face of said second housing portion.

11. The patch connector of claim 1 including:

means on at least one of said first and second housing portions for spacing said front face from a terminal block.

12. The patch connector of claim 2 wherein each of said electrical connector clips comprises:

a pair of oppositely disposed arms connected at a base and extending therefrom, said extended arms converging to a point whereupon said arms diverge and terminate at an entrance section, said entrance section being adapted to receive a terminal from the terminal block and effect electrical and mechanical connection therewith.

13. The patch connector of claim 12 wherein said base includes at least one stripping slot.

14. The patch connector of claim 12 wherein said support means for supporting and aligning said clips comprise:

at least a pair of support members in said pairs of cavities, said support members extending upwardly therefrom, said support members having an outer configuration corresponding to the configuration of the space defined between said base and said arms of said connector clips.

15. The patch connector of claim 14 including:

longitudinal alignment ridges in said cavities and extending from each of said support members toward said front face of said housing means.

16. The patch connector of claim 14 wherein said base includes a pair of oppositely disposed stripping slots and further including:

rib means in said cavities extending between said support members toward said rear face of said housing means, said rib means adapted for engagement with said stripping slots.

17. The patch connector of claim 15 wherein said base includes a pair of oppositely disposed stripping slots and further including:

rib means in said cavities extending between said support members toward said rear face of said housing means, said rib means adapted for engagement with said stripping slots.

18. The patch connector of claim 17 wherein:

said rib means are in alignment with said alignment ridges.

19. The patch connector of claim 1 including:

stain relief means in said second housing portion.

20. The patch connector of claim 19 wherein said second housing portion includes a handle and wherein said strain relief means comprises:

a lateral extension extending from a recess in said handle.

21. The patch of claim 1 wherein:

said housing means is molded.

22. A patch connector for accessing at least a pair of terminals extending outwardly from a terminal block comprising:

housing means including a first housing portion and a second housing portion, said first housing portion being attachable to said second housing portion, said housing means having a front face and a rear face;

first snap action connecting means for attaching said first and second housing portions in at least two positions including a preliminary conductor loading position and a final closed position;

second snap action connecting means for retaining said first and second housing portions in said final position, said second snap action connecting means including a pair of resilient latch means attached to said first housing portion and extending outwardly thereof, and a pair of channels on said second housing portion for receiving said latch means wherein when said resilient latch means emerges from said channels, said latch means will be urged outwardly from said housing means and wherein said latch means will be received by and retained in said channels;

at least a pair of spaced conductor retaining means in said first housing portion, each of said retaining means adapted to align a conductor in a preselected position when said first and second housing portions are attached in said preliminary position;

at least a pair of cavities in said second housing portion communicating with said conductor retaining means, said cavities defining at least a pair of electrical connector clip chambers;

a discrete electrical connector clip in each of said electrical connector clip chambers; and said front face of said housing means having at least a pair of apertures, one each of said apertures communicating with one each of said chambers, each of said apertures being large enough to receive a terminal extending from a terminal block and permit electrical contact between the terminal and said connector clip;

wherein said first and second housing portions each have a front face and wherein;

said latch means are located on said front face of said first housing portion; and wherein said channels are defined by walls located on said front face of said second housing portion.

23. A patch connector for accessing at least a pair of terminals extending outwardly from a terminal block comprising:

housing means including a first housing portion and a second housing portion, said first housing portion being attachable to said second housing portion, said housing means having a front face and a rear face;

means for attaching said first and second housing portions in at least two positions including a preliminary conductor loading position and a final closed position;

at least a pair of spaced conductor retaining means in said first housing portion, each of said retaining means adapted to align a conductor in a preselected position when said first and second housing portions are attached in said preliminary position, said spaced conductor retaining means each comprising a cylindrical opening through a wall of said first housing portion;

at least a pair of cavities in said second housing portion communicating with said conductor retaining means, said cavities defining at least a pair of electrical connector clip chambers;

a discrete electrical connector clip in each of said electrical connector clip chambers; and said front face of said housing means having at least a pair of apertures, one each of said apertures communicating with one each of said chambers, each of said apertures being large enough to receive a terminal extending from a terminal block and permit electrical contact between the terminal and said connector clip.

24. The patch of claim 23 wherein each of said conductor retaining means includes a conductor entrance section and a conductor exit section and wherein:

said conductor entrance section has a frustoconical configuration.

25. The patch of claim 23 wherein each of said conductor retaining means includes a conductor entrance section and a conductor exit section and including:

edge means depending from said first housing portion for preventing conductor travel, said edge means being spaced from said exit section.

* * * * *